US010412510B2

(12) United States Patent
Bervoets et al.

(10) Patent No.: US 10,412,510 B2
(45) Date of Patent: Sep. 10, 2019

(54) BONE CONDUCTION DEVICES UTILIZING MULTIPLE ACTUATORS

(71) Applicant: COCHLEAR LIMITED, Macquarie University (AU)

(72) Inventors: Wim Bervoets, Mechelen (BE); Joris Walraevens, Mechelen (BE); Patrik Kennes, Mechelen (BE)

(73) Assignee: COCHLEAR LIMITED, Macquarie University (AU)

( * ) Notice: Subject to any disclaimer, the term of this patent is extended or adjusted under 35 U.S.C. 154(b) by 438 days.

(21) Appl. No.: 15/158,122

(22) Filed: May 18, 2016

(65) Prior Publication Data

US 2017/0094429 A1 Mar. 30, 2017

Related U.S. Application Data

(60) Provisional application No. 62/233,093, filed on Sep. 25, 2015.

(51) Int. Cl.

| | |
|---|---|
| ***H04R 25/00*** | (2006.01) |
| *H04R 15/00* | (2006.01) |
| *H04R 17/00* | (2006.01) |

(52) U.S. Cl.

CPC ..... *H04R 25/606* (2013.01); *H04R 15/00* (2013.01); *H04R 17/00* (2013.01); *H04R 2430/03* (2013.01); *H04R 2460/13* (2013.01)

(58) Field of Classification Search

CPC ..... H04R 25/606; H04R 2460/13

See application file for complete search history.

(56) References Cited

U.S. PATENT DOCUMENTS

| | | | | |
|---|---|---|---|---|
| 8,170,252 | B2 | 5/2012 | Parker et al. | |
| 8,837,760 | B2 | 9/2014 | Andersson et al. | |
| 2004/0088051 | A1* | 5/2004 | Seligman | H04R 25/556 623/10 |
| 2007/0167671 | A1 | 7/2007 | Miller, III | |
| 2012/0253104 | A1* | 10/2012 | Andersson | H04R 17/00 600/25 |
| 2012/0302822 | A1* | 11/2012 | Van Himbeeck | H04R 25/606 600/25 |
| 2013/0089229 | A1 | 4/2013 | Kristo et al. | |
| 2014/0286513 | A1 | 9/2014 | Hillbratt et al. | |
| 2014/0336447 | A1* | 11/2014 | Bjorn | H04R 25/606 600/25 |
| 2015/0119635 | A1* | 4/2015 | Gustafsson | A61F 11/045 600/25 |
| 2015/0208183 | A1* | 7/2015 | Bern | H04R 25/65 381/326 |
| 2015/0249894 | A1 | 9/2015 | Andersson et al. | |

OTHER PUBLICATIONS

International Search Report and Written Opinion for PCT/IB2016/002005, dated Jun. 19, 2017, 12 pages.

International Preliminary Report on Patentability for PCT/IB2016/002005, dated Mar. 27, 2018, 9 pages.

* cited by examiner

*Primary Examiner* — Thaddeus B Cox

(74) *Attorney, Agent, or Firm* — Merchant & Gould P.C.

(57) ABSTRACT

A bone conduction device includes split high-frequency and low-frequency actuators. The frequency response of the low-frequency actuator can be restricted to the lower range of hearing frequencies to improve performance. The high-frequency actuator can be implanted under tissue close to the cochlea to improve transmission efficiency, since high-frequency vibrations suffer greater attenuation.

20 Claims, 12 Drawing Sheets

BONE CONDUCTION DEVICES UTILIZING MULTIPLE ACTUATORS

BACKGROUND

Hearing loss, which can be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient (i.e., the inner ear of the recipient) to bypass the mechanisms of the middle and outer ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss can retain some form of residual hearing because some or all of the hair cells in the cochlea function normally.

Individuals suffering from conductive hearing loss often receive a conventional hearing aid. Such hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to conventional hearing aids, which rely primarily on the principles of air conduction, certain types of hearing prostheses commonly referred to as bone conduction devices, convert a received sound into vibrations. The vibrations are transferred through the skull to the cochlea causing motion of the perilymph and stimulation of the auditory nerve, which results in the perception of the received sound. Bone conduction devices are suitable to treat a variety of types of hearing loss and can be suitable for individuals who cannot derive sufficient benefit from conventional hearing aids.

SUMMARY

A bone conduction device includes multiple actuators, e.g., high-frequency and low-frequency actuators. The frequency response of the low-frequency actuator can be restricted to the lower range of hearing frequencies to improve performance. The high-frequency actuator can be smaller and can be implanted under tissue close to the cochlea to improve transmission efficiency, since high-frequency vibrations suffer greater attenuation. Different transducers, such as electromechanical and piezoelectric transducers, can be utilized for either or both of the high-end low-frequency stimulators. In an example, an electromechanical transducer can be used for the low frequencies and a piezoelectric transducer can be used for the high frequencies. Transducer selection is dependent on the desired performance characteristics of the respective transducers. Bone screws can be utilized to secure either or both of the actuators.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

The technologies described herein can be utilized in auditory prostheses such as bone conduction devices. Such devices can include two or more vibrating actuators utilized to deliver vibration stimuli to a skull of a recipient. Although any number of actuators can be utilized, use of two actuators can be desirable, due to the implantation procedures involved. In that case, bone conduction devices using only two actuators are described herein for clarity. Different classes of bone conduction devices that deliver vibration stimuli to a recipient via different modes of stimulation can benefit from the technologies described herein. For example, percutaneous bone conduction devices deliver stimuli from an external transducer to the skull via an anchor fixed to the skull. Passive transcutaneous bone conduction devices deliver stimuli from an external transducer to the skull via an external plate that directly vibrates the skull, through the intervening tissue. Active transcutaneous bone conduction devices include an implanted transducer that receives signals from an external portion of the device and delivers appropriate vibration directly to the skull, e.g., via an implanted anchor. Each of these types of bone conduction devices can include a plurality of actuators, and certain devices can deliver stimuli to a recipient using different modes of stimulation (e.g., a device can deliver stimuli in a first range of frequencies via a percutaneous mode or passive transcutaneous and can deliver stimuli in a second range of frequencies via an active transcutaneous mode). Several examples of such devices are described below and the configurations of others will be apparent to a person of skill in the art upon review of the disclosure. Moreover, the dual actuator technologies described herein can be utilized in auditory prostheses that utilize a bone conduction actuator in conjunction with a middle ear device configured to vibrate at least one of an ossicle and a round window of a recipient. All of the above-described auditory prostheses deliver a hearing percept to a recipient of the prosthesis. Multiple actuators associated with a single auditory prosthesis can produce hearing percepts independent of each other.

Figure 1:
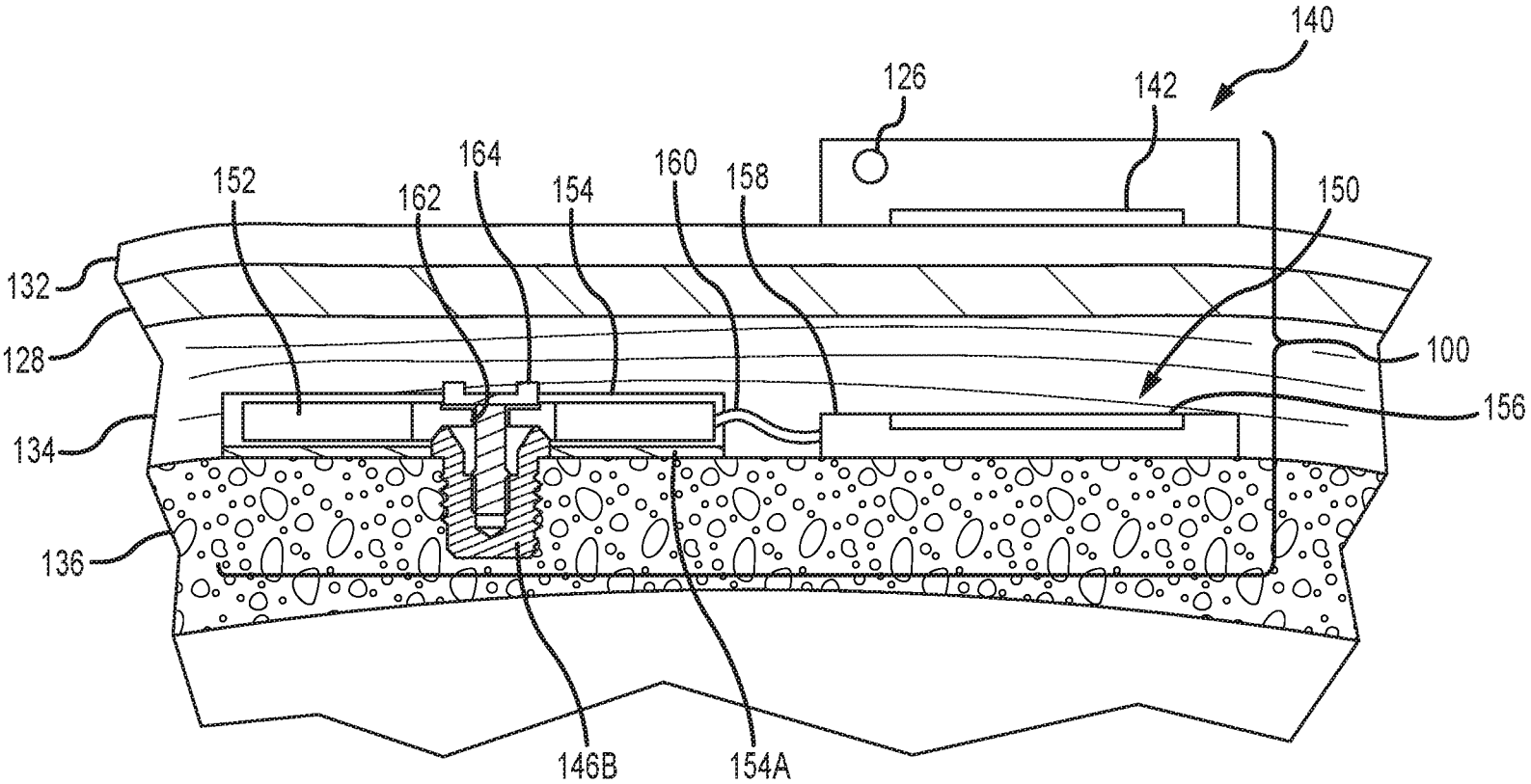
FIG. 1 depicts a partial cross-sectional schematic view of an active transcutaneous bone conduction device worn on a recipient.

FIG. 1 depicts a partial cross-sectional schematic view of an active transcutaneous bone conduction device 100 worn on a recipient. The active transcutaneous bone conduction device 100 includes an external device 140 and an implantable component 150. The bone conduction device 100 of FIG. 1 is an active transcutaneous bone conduction device in that the vibrating actuator 152 is located in the implantable component 150. Specifically, a vibratory element in the form of vibrating actuator 152 is located in an encapsulant 154 of the implantable component 150. In the various examples described herein, implanted encapsulants 154 can be biocompatible ceramic, plastic, or other materials. In an example, much like the vibrating actuator 152 described below with respect to transcutaneous bone conduction devices, the vibrating actuator 152 is a device that converts electrical signals into vibration.

External component 140 includes a sound input element 126 that converts sound into electrical signals. Specifically, the transcutaneous bone conduction device 100 provides these electrical signals to a sound processor (not shown) that processes the electrical signals, and then provides those processed signals to the implantable component 150 through the skin 132, fat 128, and muscle 134 of the recipient via a magnetic inductance link. In this regard, a transmitter coil 142 of the external component 140 transmits these signals to implanted receiver coil 156 located in an encapsulant 158 of the implantable component 150. The vibrating actuator 152 converts the electrical signals into vibrations. In another example, signals associated with external sounds can be sent to an implanted sound processor disposed in the encapsulant 158, which then generates electrical signals to be delivered to vibrating actuator 152 via electrical lead assembly 160.

The vibrating actuator 152 is mechanically coupled to the encapsulant 154. Encapsulant 154 and vibrating actuator 152 collectively form a vibrating element. The encapsulant 154 is substantially rigidly attached to bone fixture 146B, which is secured to bone 136. A silicone layer 154A can be disposed between the encapsulant 154 and the bone 136. In this regard, encapsulant 154 includes through hole 162 that is contoured to the outer contours of the bone fixture 146B. Screw 164 is used to secure encapsulant 154 to bone fixture 146B. The portions of screw 164 that interface with the bone fixture 146B substantially correspond to the abutment screw detailed below, thus permitting screw 164 to readily fit into an existing bone fixture used in a percutaneous bone conduction device (or an existing passive transcutaneous bone conduction device such as that detailed elsewhere herein). In an example, screw 164 is configured so that the same tools and procedures that are used to install and/or remove an abutment screw from bone fixture 146B can be used to install and/or remove screw 164 from the bone fixture 146B.

Figure 2A:
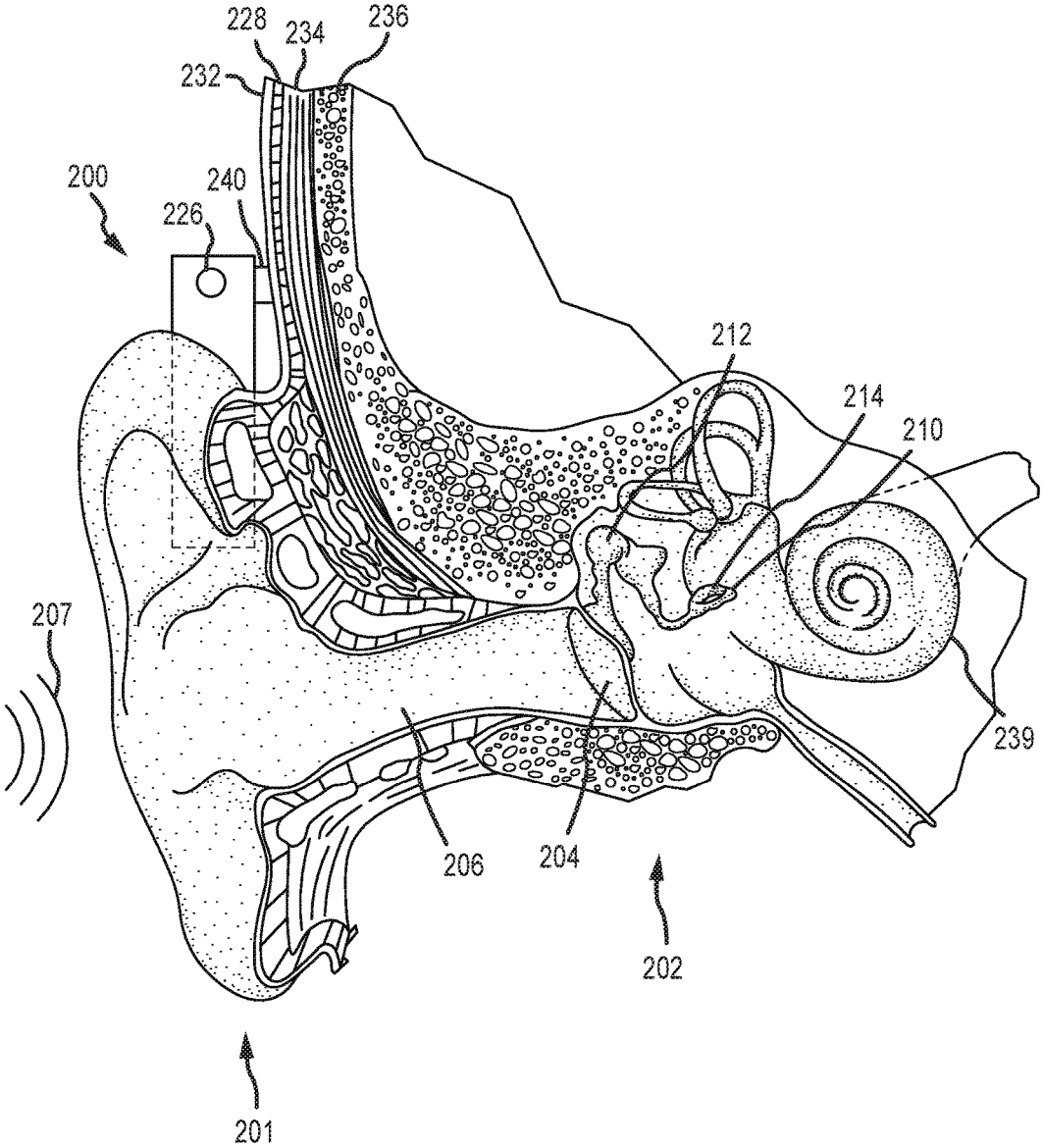
FIG. 2A depicts a partial perspective view of a percutaneous bone conduction device worn on a recipient.

FIG. 2A depicts a partial perspective view of a percutaneous bone conduction device 200 positioned behind outer ear 201 of the recipient and comprises a sound input element 226 to receive sound signals 207. The sound input element 226 can be a microphone, telecoil, or similar. In the present example, sound input element 226 can be located, for example, on or in bone conduction device 200, or on a cable extending from bone conduction device 200. Also, bone conduction device 200 comprises a sound processor (not shown), a vibrating electromagnetic actuator, and/or various other operational components as described elsewhere herein.

More particularly, sound input device 226 converts received sound signals into electrical signals. These electrical signals are processed by the sound processor. The sound processor generates control signals that cause the actuator to vibrate. In other words, the actuator converts the electrical signals into mechanical force to impart vibrations to skull bone 236 of the recipient.

Bone conduction device 200 further includes coupling apparatus 240 to attach bone conduction device 200 to the recipient. In the example of FIG. 2A, coupling apparatus 240 is attached to an anchor system (not shown) implanted in the recipient. An exemplary anchor system (also referred to as a fixation system) can include a percutaneous abutment fixed to the recipient's skull bone 236. The abutment extends from skull bone 236 through muscle 234, fat 228, and skin 232 so that coupling apparatus 240 can be attached thereto. Such a percutaneous abutment provides an attachment location for coupling apparatus 240 that facilitates efficient transmission of mechanical force.

It is noted that sound input element 226 can be a device other than a microphone, such as, for example, a telecoil, etc. In an example, sound input element 226 can be located remote from the bone conduction device 200 and can take the form of a microphone or the like located on a cable or can take the form of a tube extending from the device 200, etc. Alternatively, sound input element 226 can be subcutaneously implanted in the recipient, or positioned in the recipient's ear canal or positioned within the pinna. Sound input element 226 can also be a component that receives an electronic signal indicative of sound, such as, from an external audio device. For example, sound input element 226 can receive a sound signal in the form of an electrical signal from an MP3 player or a smartphone electronically connected to sound input element 226.

The sound processing unit of the bone conduction device 200 processes the output of the sound input element 226, which is typically in the form of an electrical signal. The processing unit generates control signals that cause an associated actuator to vibrate. In other words, the actuator converts the electrical signals into mechanical vibrations for delivery to the recipient's skull. These mechanical vibrations are delivered as described below.

Figure 2B:
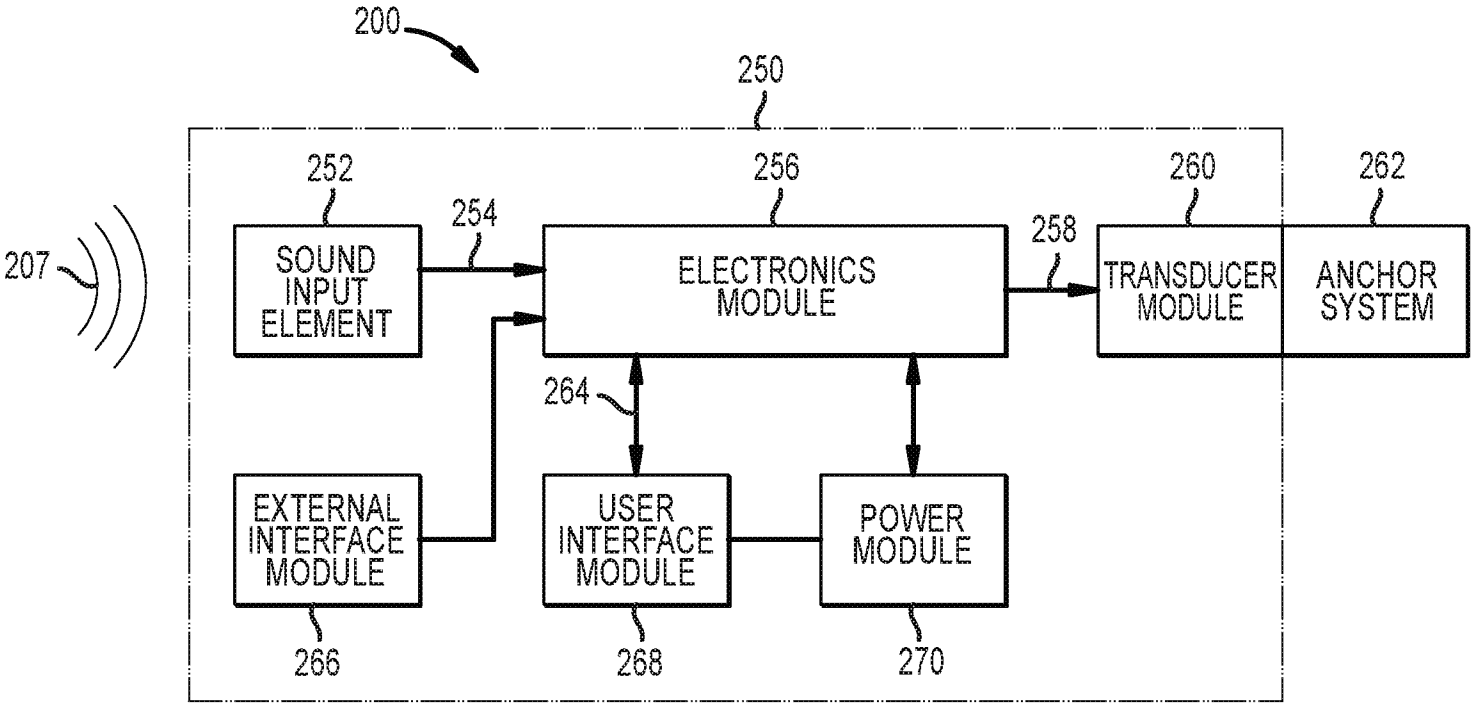
FIG. 2B is a schematic diagram of a percutaneous bone conduction device.

FIG. 2B is a schematic diagram of a percutaneous bone conduction device 200, such as the device depicted in FIG. 2A. Sound 207 is received by sound input element 252. In some arrangements, sound input element 252 is a microphone configured to receive sound 207, and to convert sound 207 into electrical signal 254. Alternatively, sound 207 is received by sound input element 252 as an electrical signal. As shown in FIG. 2B, electrical signal 254 is output by sound input element 252 to electronics module 256. Electronics module 256 is configured to convert electrical signal 254 into adjusted electrical signal 258. As described below in more detail, electronics module 256 can include a sound processor, control electronics, transducer drive components, and a variety of other elements.

As shown in FIG. 2B, transducer 260 receives adjusted electrical signal 258 and generates a mechanical output force in the form of vibrations that is delivered to the skull of the recipient via anchor system 262, which is coupled to bone conduction device 200. Delivery of this output force causes motion or vibration of the recipient's skull, thereby activating the hair cells in the recipient's cochlea (not shown) via cochlea fluid motion.

FIG. 2B also illustrates power module 270. Power module 270 provides electrical power to one or more components of bone conduction device 200. For ease of illustration, power module 270 has been shown connected only to user interface module 268 and electronics module 256. However, it should be appreciated that power module 270 can be used to supply power to any electrically powered circuits/components of bone conduction device 200.

User interface module 268, which is included in bone conduction device 200, allows the recipient to interact with bone conduction device 200. For example, user interface module 268 can allow the recipient to adjust the volume, alter the speech processing strategies, power on/off the device, etc. In the example of FIG. 2B, user interface module 268 communicates with electronics module 256 via signal line 264.

Bone conduction device 200 can further include external interface module 266 that can be used to connect electronics module 256 to an external device, such as a fitting system. Using external interface module 266, the external device, can obtain information from the bone conduction device 200 (e.g., the current parameters, data, alarms, etc.), and/or modify the parameters of the bone conduction device 200 used in processing received sounds and/or performing other functions.

In the example of FIG. 2B, sound input element 252, electronics module 256, transducer 260, power module 270, user interface module 268, and external interface module 266 have been shown as integrated in a single housing, referred to as an auditory prosthesis housing or an external portion housing 250. However, it should be appreciated that in certain examples, one or more of the illustrated components can be housed in separate or different housings. Similarly, it should also be appreciated that in such examples, direct connections between the various modules and devices are not necessary and that the components can communicate, for example, via wireless connections. Various components (e.g., sound input element 252, electronics module 256, transducer 260, power module 270, user interface module 268, and so on) are also incorporated into the active and passive transcutaneous bone conduction devices described herein.

Figure 3:
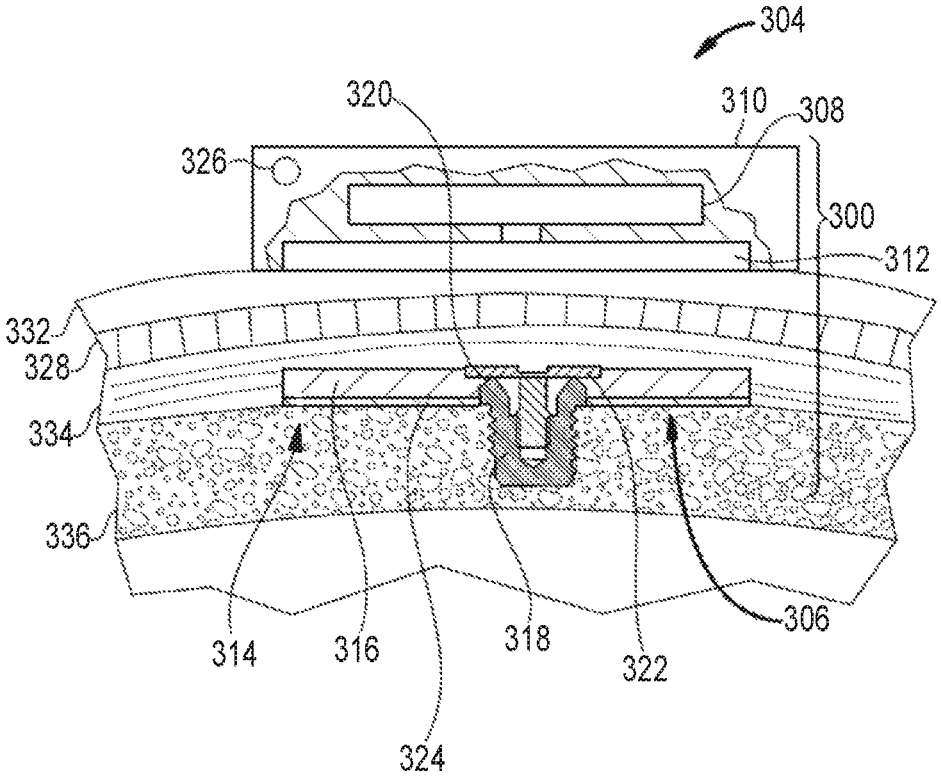
FIG. 3 depicts a partial cross-sectional schematic view of a passive transcutaneous bone conduction device worn on a recipient.

FIG. 3 depicts an example of a transcutaneous bone conduction device 300 that includes an external portion 304 and an implantable portion 306. The transcutaneous bone conduction device 300 of FIG. 3 is a passive transcutaneous bone conduction device in that a vibrating actuator 308 is located in the external portion 304. Vibrating actuator 308 is located in housing 310 of the external component, and is coupled to a pressure or transmission plate 312. The pressure plate 312 can be in the form of a permanent magnet and/or in another form that generates and/or is reactive to a magnetic field, or otherwise permits the establishment of magnetic attraction between the external portion 304 and the implantable portion 306 sufficient to hold the external portion 304 against the skin of the recipient. Magnetic attraction can be further enhanced by utilization of a magnetic implantable plate 316 that is secured to the bone 336. Single magnets are depicted in FIG. 3. In alternative examples, multiple magnets in both the external portion 304 and implantable portion 306 can be utilized. In a further alternative example the pressure plate 312 can include an additional plastic or biocompatible encapsulant (not shown) that encapsulates the pressure plate 312 and contacts the skin 332 of the recipient.

In an example, the vibrating actuator 308 is a device that converts electrical signals into vibration. In operation, sound input element 326 converts sound into electrical signals. Specifically, the transcutaneous bone conduction device 300 provides these electrical signals to vibrating actuator 308, via a sound processor (not shown) that processes the electrical signals, and then provides those processed signals to vibrating actuator 308. The vibrating actuator 308 converts the electrical signals into vibrations. Because vibrating actuator 308 is mechanically coupled to pressure plate 312, the vibrations are transferred from the vibrating actuator 308 to pressure plate 312. Implantable plate assembly 314 is part of the implantable portion 306, and can be made of a ferromagnetic material that can be in the form of a permanent magnet. The implantable portion 306 generates and/or is reactive to a magnetic field, or otherwise permits the establishment of a magnetic attraction between the external portion 304 and the implantable portion 306 sufficient to hold the external portion 304 against the skin 332 of the recipient. Accordingly, vibrations produced by the vibrating actuator 308 of the external portion 304 are transferred from pressure plate 312 to implantable plate 316 of implantable plate assembly 314. This can be accomplished as a result of mechanical conduction of the vibrations through the skin 332, resulting from the external portion 304 being in direct contact with the skin 332 and/or from the magnetic field between the two plates 312, 316. These vibrations are transferred without a component penetrating the skin 332, fat 328, or muscular 334 layers on the head.

As can be seen, the implantable plate assembly 314 is substantially rigidly attached to bone fixture 318 in this example. Implantable plate assembly 314 includes through hole 320 that is contoured to the outer contours of the bone fixture 318, in this case, a bone fixture 318 that is secured to the bone 336 of the skull. This through hole 320 thus forms a bone fixture interface section that is contoured to the exposed section of the bone fixture 318. In an example, the sections are sized and dimensioned such that at least a slip fit or an interference fit exists with respect to the sections. Plate screw 322 is used to secure implantable plate assembly 314 to bone fixture 318. As can be seen in FIG. 3, the head of the plate screw 322 is larger than the hole through the implantable plate assembly 314, and thus the plate screw 322 positively retains the implantable plate assembly 314 to the bone fixture 318. In certain examples, a silicon layer 324 is located between the implantable plate 316 and bone 336 of the skull.

Different configurations of dual-actuator bone conduction devices are depicted in the following figures. The dual-actuator bone conduction devices can utilize any combination of actuator types and modes of stimulation (percutaneous, active transcutaneous, passive transcutaneous) to produce the required or desired stimulus for a particular device recipient. For example, with regard to actuator types, electromechanical, piezoelectric, magnetostrictive, or other types of actuators can be utilized. It has been discovered that relatively lower frequency stimuli are more efficiently delivered by electromechanical actuators, while higher frequency stimuli are more efficiently delivered by piezoelectric actuators. As such, desirable actuator types and modes of stimulation include utilizing an implanted electromechanical actuator (for low frequencies) in conjunction with an implanted piezoelectric actuator (for high frequencies). In another example, a passive transcutaneous electromechanical actuator (low frequencies) can be used in conjunction with an implanted piezoelectric actuator (high frequencies). In another example, two implanted electromechanical actuators can be used. In yet another example, a percutaneous electromechanical actuator (low frequencies) can be used with an implanted piezoelectric actuator (high frequencies). Given the breadth of combinations available, in the examples depicted in FIGS. 4-6B, electromechanical and piezoelectric actuators can be used as either or both of the depicted actuators. It should be noted, however, a low frequency electromechanical actuator in combination with a high-frequency piezoelectric actuator can be advantageous because it leverages the inherent characteristics of these technologies to improve efficiency, as described elsewhere herein.

Piezoelectric actuators can be made physically smaller than electromechanical actuators, which allow them to be more closely implanted proximate the cochlea. This can be desirable because relatively higher frequency signals suffer greater attenuation as they travel through the skull. Thus, the small piezoelectric actuators can be more easily implanted proximate the cochlea to produce desirable results. An associated electromechanical actuator can be installed further from the cochlea, for example, within an external portion of a percutaneous bone conduction device, to deliver the relatively lower frequency signals. In examples, the distance between a lower frequency actuator disposed distal from the cochlea and a higher frequency actuator disposed proximate the cochlea can be between about 20 mm to about 100 mm. In another example, the separation distance may be between about 35 mm and about 50 mm. Regardless of the separation distance, the higher frequency actuator is typically disposed at the end of a lead that is sized as appropriate for the particular application (e.g., in the above examples, between about 20 mm to about 100 mm, or between about 35 mm and about 50 mm). By placing the high-frequency actuator proximate the cochlea, stimuli emitted therefrom can be perceived as louder than stimuli emitted from the low frequency actuator. As such, the output of the low frequency actuator may need adjustment to balance the perceived volume. This can be managed in part during post-surgery fitting to account for surgical variation.

The terms "high" and "low" frequency are relative terms used to identify the range of frequencies delivered by a particular actuator in a dual-actuator bone conduction device. Additionally, the transition frequency and frequency range for each actuator may depend on several conditions, such as actuator type, mode of stimulation, actuator fixation and position, individual recipient anatomy, skin thickness (e.g., for passive transcutaneous devices), hearing loss characteristics, and so on. The transition frequency identifies the frequency below which signals are sent to the low frequency actuator and the actuator can be restricted to the lower range of hearing frequencies to improve performance. The high-frequency actuator can be a passive transcutaneous electromechanical actuator and an implanted piezoelectric actuator is typically about 300 Hz to about 4 kHz. Depending on the system dynamics, the optimal transition frequency can be between about 400 Hz and about 3 kHz, or about 500 Hz and about 2 kHz, or about 600 Hz and about 1 kHz, or about 700 Hz and about 900 Hz. Other transition frequencies are contemplated. Additionally, the transition frequency need not be a single, defined frequency, e.g., 2 kHz. Instead, both the low and high-frequency actuator may emit signals associated with an overlapping range of frequencies, which prevents a frequency gap between stimuli emitted by the low frequency actuator and stimuli emitted by the high-frequency actuator. In other examples, the frequency ranges may not overlap and instead can be entirely discrete from each other.

Figure 4:
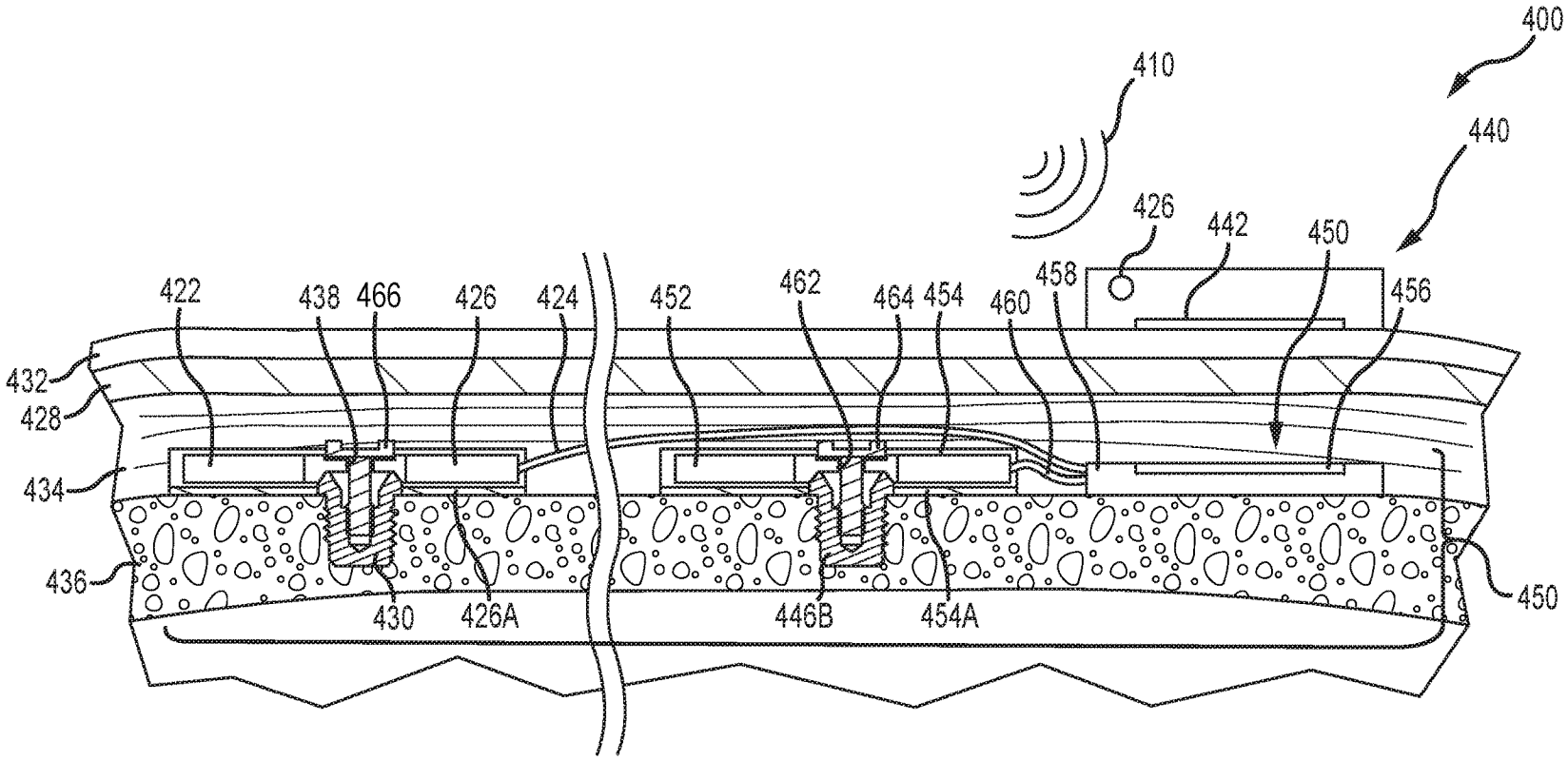
FIG. 4 depicts a partial cross-sectional schematic view of a dual-actuator active transcutaneous bone conduction device worn on a recipient.

FIG. 4 depicts a partial cross-sectional schematic view of a dual-actuator active transcutaneous bone conduction device 400 worn on a recipient. The active transcutaneous bone conduction device 400 includes an external device 440 and an implantable component 450. Here, the implantable component 450 includes two vibratory elements in the form of vibrating actuators 452 and 422. As described above, the vibrating actuator 452 is an electromechanical or piezoelectric actuator and is configured to produce associated vibrations for sounds 410 having relatively lower frequencies. In that regard, the vibrating actuator 452 is referred to as a low-frequency actuator. The vibrating actuator 422 is an electromechanical or piezoelectric actuator and is configured to produce associated vibrations for sounds 410 having frequencies generally greater than the upper limit of the low-frequency actuator. In that regard, the vibrating actuator 422 is referred to as a high-frequency actuator.

External component 440 includes a sound input element 426 that converts sound 410 into electrical signals. Specifically, the transcutaneous bone conduction device 400 provides these electrical signals to the low-frequency vibrating actuator 452 or the high-frequency vibrating actuator 422, or to a sound processor (not shown) that processes the electrical signals, and then provides those processed signals to the implantable component 450 through the skin 432, fat 428, and muscle 434 of the recipient via a magnetic inductance link. In this regard, a transmitter coil 442 of the external component 440 transmits these signals to implanted receiver coil 456 located in encapsulant 458 of the implantable component 450. Components (not shown) in the encapsulant 458, such as, for example, a signal generator or an implanted sound processor, then generate electrical signals to be delivered to the vibrating actuator 452 or the vibrating actuator 422 via electrical lead assemblies 460 or 424, respectively. In an alternative embodiment, the vibrating actuator 452 can be integrated with the implantable component 450. The signal generator or sound processor disposed within the encapsulant 458 identifies the frequency or frequencies of the sound 410 and sends the associated electrical signals to the appropriate vibrating actuator 452, 422. The vibrating actuator 452 or the vibrating actuator 422 converts the electrical signals into vibrations. Of course, complex sounds 410 can necessitate signals being sent to both of the vibrating actuator 452 and the vibrating actuator 422. To ensure proper receipt of the vibration stimuli, the signal generator or sound processor can include a timing module that sends the stimulus signals to the vibrating actuators 452, 422 at appropriate times. In one example, the electrical lead assemblies 460, 424 can be the same length, but the electrical lead assembly to the closer actuator (in this case lead assembly 460 to the low-frequency actuator 452) can be coiled or otherwise routed to maintain its length.

The components associated with the low-frequency vibrating actuator 452 are described above generally with regard to the sole vibrating actuator depicted in FIG. 1. Thus, the components of the low-frequency vibrating actuator 452 are numbered consistently with that of FIG. 1 and are not necessarily described further. With regard to the high-frequency vibrating actuator 422, it can be disposed within its own encapsulant 426. Encapsulant 426 and vibrating actuator 422 collectively form a vibrating element. In examples, the encapsulant 426 is substantially rigidly attached to a bone fixture 430, which is secured to bone 436. In alternative embodiments, the high-frequency actuator 422 need not be securely fixed to the bone, but may instead be embedded in tissue, and the transmission of stimuli is not necessarily adversely effected. A silicone layer 426A can be disposed between the encapsulant 426 and the bone 436. Encapsulant 426 includes a through hole 438 that is contoured to the outer contours of the bone fixture 430 and a screw 466 is used to secure the encapsulant 426 to the bone fixture 430. As described elsewhere herein, the high-frequency actuator 422 is implanted proximate the cochlea.

Figure 5A:
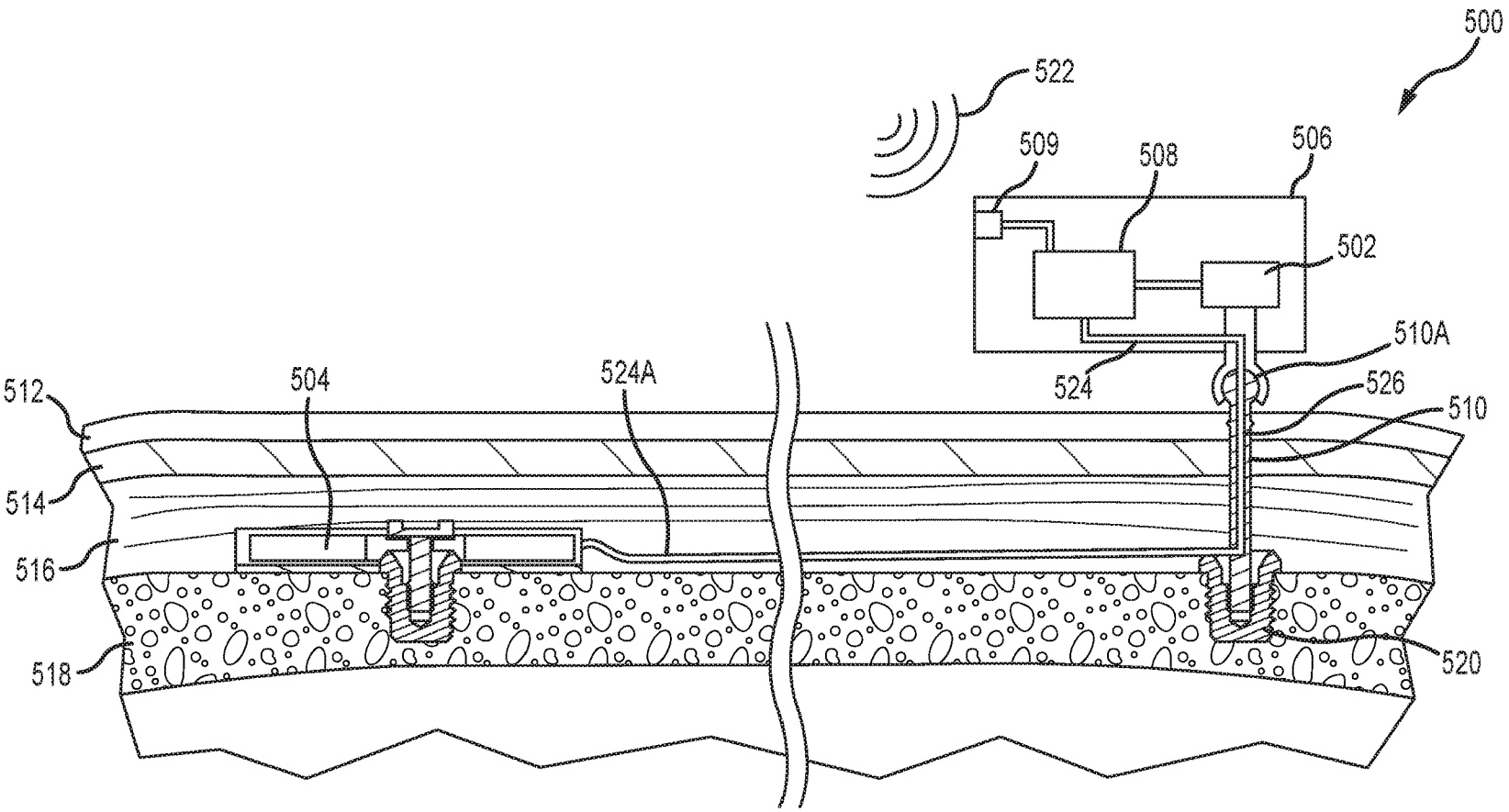
FIG. 5A depicts a partial cross-sectional schematic view of an example of a dual-actuator bone conduction device, having both a percutaneous actuator and an active transcutaneous actuator, worn on a recipient.

FIG. 5A depicts a partial cross-sectional schematic view of a dual-actuator bone conduction device 500, having both a percutaneous vibrating actuator 502 and an active transcutaneous actuator 504. The percutaneous vibrating actuator 502 is disposed within an external portion 506 that includes a sound processor 508, sound input element 509, and other components and elements, as depicted, e.g., generally in FIG. 2B. Such elements are not necessarily described further. The percutaneous vibrating actuator 502 operates as a low-frequency vibrating actuator, while the active transcutaneous vibrating actuator 504 operates as a high-frequency vibrating actuator. The functionality of these different vibrating actuators 502, 504 is described in more detail herein. As with the percutaneous bone conduction device depicted in FIGS. 2A and 2B, the low-frequency vibrating actuator 502 is connected to a bone anchor or abutment screw 510 that passes through skin 512, fat 514, and muscle 516 layers and is anchored directly to the skull bone 518. A bone fixture 520 secures the bone anchor 510 directly to the bone 518. The vibrating actuator 502 is connected to the bone anchor 510 with a snap connection element 510A, magnetic connection, a fixation screw, or combinations thereof. Sound 522 is received by the sound input element 509 and send to the sound processor 508. Vibrational stimuli corresponding to sound 522 having low-frequencies (as described above) are transmitted directly from the vibrating actuator 502 to the bone 518, via the bone anchor 510 and bone fixture 520. For sound 522 having frequencies greater than those assigned to the low-frequency actuator 502, the sound processor 508 directs signals to the implanted high-frequency actuator 504. In FIG. 5A, an electrical lead assembly 524 is routed from the sound processor 508, though an opening or channel 526 in the bone anchor 510. An implanted portion 524A of the electrical lead assembly 524 is disposed along the bone 518 to the high-frequency vibrating actuator 504. In another embodiment, the bone anchor 510 itself can form a portion of the electrical lead assembly 524 and signals generated by the sound processor 508 can pass therethrough. An implanted electrical lead assembly 524A is connected to the bone anchor 510 and transmits signals to the high-frequency vibrating actuator 504. The high-frequency vibrating actuator 504 can include a number of components, such as those depicted elsewhere herein. These components are not described further. Again, the high-frequency actuator 502 is typically implanted remote or distal from the low-frequency actuator 502 (more specifically, from the area into which the low-frequency actuator 502 delivers its stimulus). In examples, this remote location is proximate the cochlea and can be connected to bone or otherwise disposed within tissue. The low-frequency actuator 502 is located proximate (here, in) a housing of the external portion 506.

Figure 5B:
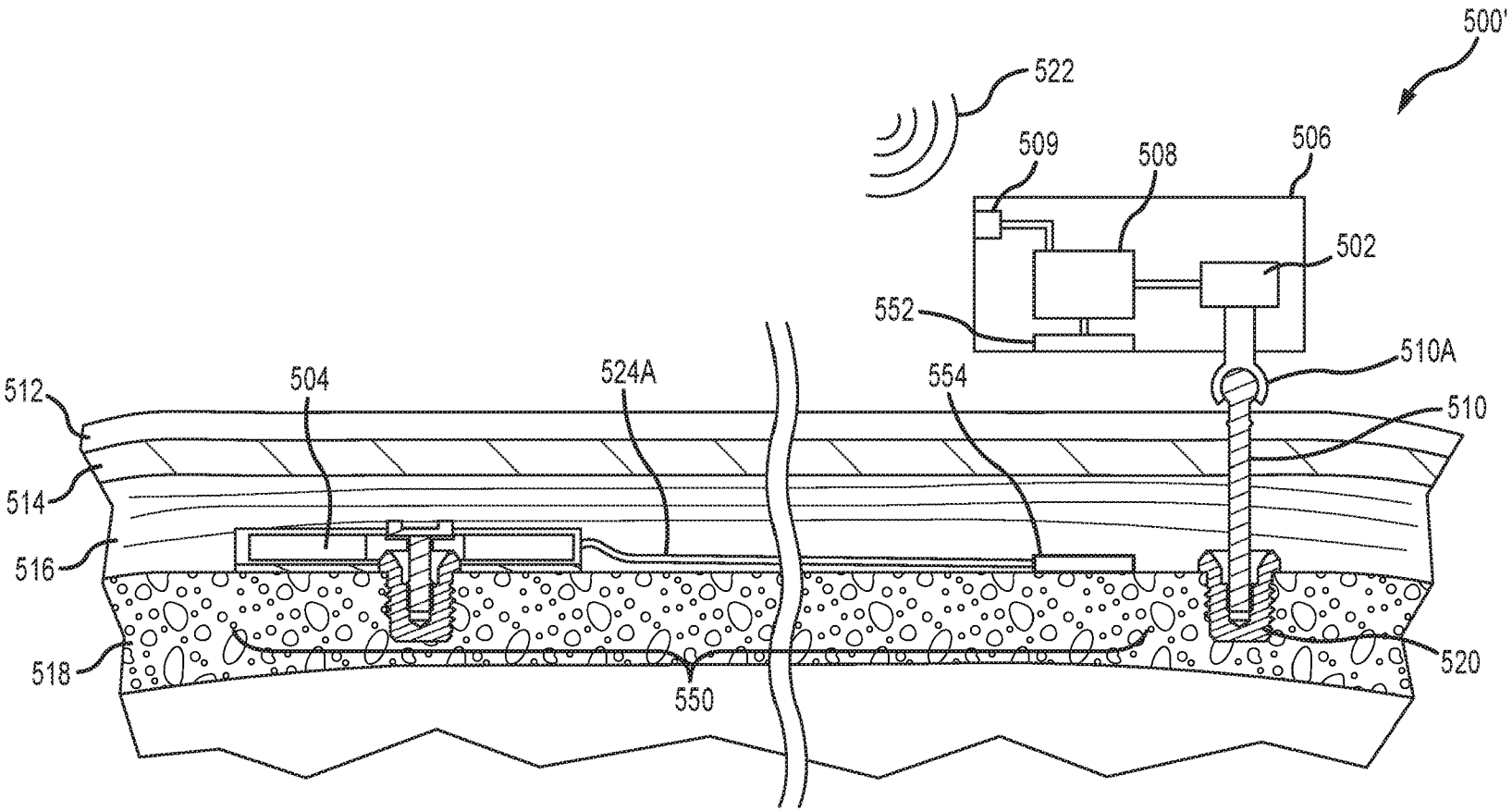
FIG. 5B depicts a partial cross-sectional schematic view of another example of a dual-actuator bone conduction device, having both a percutaneous actuator and an active transcutaneous actuator, worn on a recipient.

FIG. 5B depicts a partial cross-sectional schematic view of a dual-actuator bone conduction device 500', having both a percutaneous vibrating actuator 502 and an active transcutaneous actuator 504. A number of components depicted in FIG. 5B are depicted above in FIG. 5A, are numbered consistently therewith, and are not necessarily described further. One distinction between the bone conduction device 500' of FIG. 5B and that depicted and described in FIG. 5A is that a wireless communication system is used to send signals from the external portion 506 to an implanted portion or component 550. The external portion 506 includes a coil 552 disposed within an external portion housing that sends a signal to an implanted receiver coil 554, as described elsewhere herein. These signals are transmitted along electrical lead assembly 524A to the high-frequency vibrating actuator 504. Components of both the implanted portion 550 and implanted vibrating actuator 504 are described above with regard to the implantable portion depicted in FIG. 1. These components include, but are not limited to, the bone fixture, screw, encapsulants, and so on, and are not described further. Again, the high-frequency vibrating actuator 504 can be implanted proximate the cochlea, connected to bone or disposed within tissue.

Figure 6A:
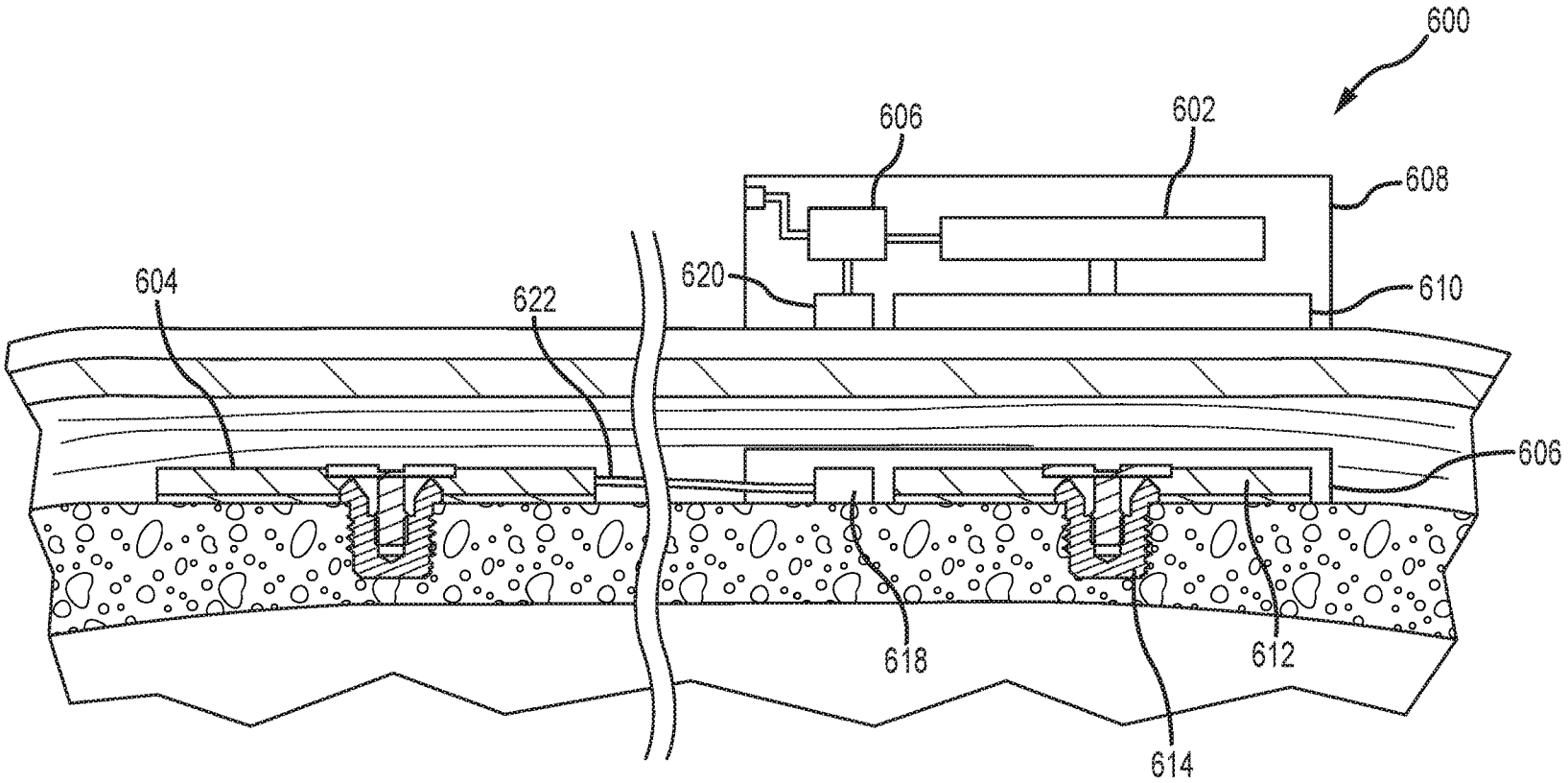
FIG. 6A depicts a partial cross-sectional schematic view of an example of a dual-actuator bone conduction device, having both a passive transcutaneous actuator and an active transcutaneous actuator, worn on a recipient.

FIG. 6A depicts a partial cross-sectional schematic view of an example of a dual-actuator bone conduction device 600, having both a passive transcutaneous actuator 602 and an active transcutaneous actuator 604. A number of elements depicted in FIG. 6A are also depicted and described elsewhere herein. Thus, those components are not necessarily described further. A sound processor 606 is disposed within a housing of an external portion 608 of an auditory prosthesis. An electrical signal corresponding to a low-frequency sound signal is sent to the external low-frequency actuator 602, which sends a vibrating stimulus to a plate or other transmission element 610. The vibration is transmitted through the skin, fat, and muscle of the recipient and received by the implantable plate 612, which is secured to the skull with a bone fixture 614, as described elsewhere herein. The implantable plate 612 can be disposed proximate an implantable coil 618, both of which can be secured directly to the skull or disposed within a biocompatible encapsulant 616 (such as silicone) that is secured to the skull. In another example, the plate 612 can be disposed in a separate encapsulant from the coil 618, and both may be directly secured to the skull. The implantable coil 618 is configured to send and receive wireless signals from an external coil 620 disposed in the external portion 608. In examples, the implantable coil 618 can be disposed about the implantable plate 612. The external coil 620 and transmission element 610 can be similarly configured. The external coil 620 sends electrical signals received from the sound processor 606 to the implantable coil 618. The received signals are transmitted along an electrical lead assembly 622 to the implanted high-frequency active transcutaneous actuator 604 that provides vibrating stimulus to the recipient. This vibrating stimulus is associated with external sounds having a high frequency.

Figure 6B:
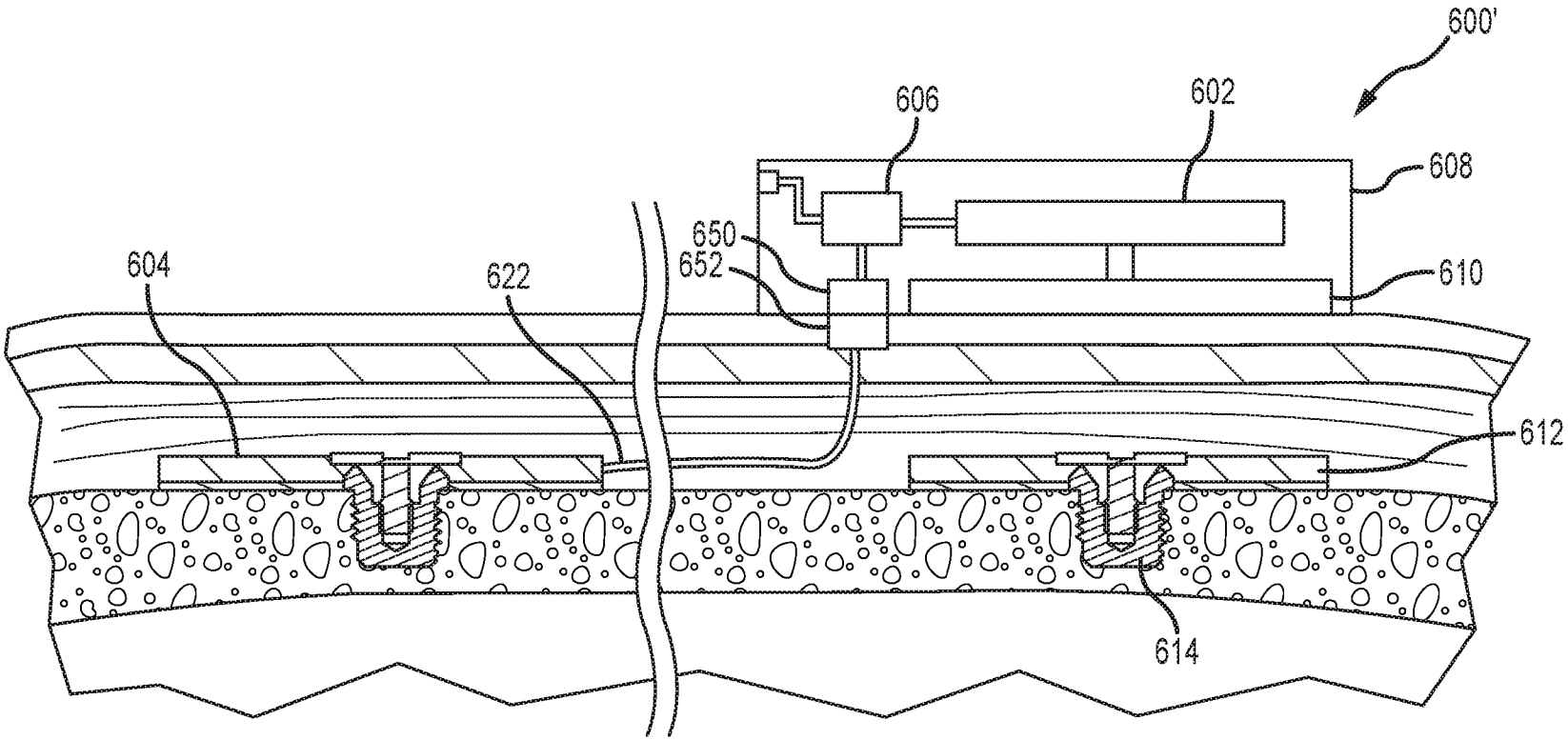
FIG. 6B depicts a partial cross-sectional schematic view of another example of a dual-actuator bone conduction device, having both a passive transcutaneous actuator and an active transcutaneous actuator, worn on a recipient.

FIG. 6B depicts a partial cross-sectional schematic view of another example of a dual-actuator bone conduction device 600', having both a passive transcutaneous actuator 602 and an active transcutaneous actuator 604. A number of components depicted in FIG. 6B are depicted above in FIG. 6A, are numbered consistently therewith, and are not necessarily described further. One distinction between the bone conduction device 600' of FIG. 6B and that depicted and described in FIG. 6A is that an external contact 650 is used to send a signal from the external portion 608 to an implanted contact 652. In one example, the contact 650 is can be a wire or projection that extends from the external portion 608 and penetrates a septum implanted in the surface of the skin. By piercing the septum, the projection contact 650 contacts the mating contact 652 disposed below, allowing signals to be communicated to an implanted high-frequency actuator 604. Other contact configurations are contemplated. Unitary implanted contacts and electrical lead assemblies are also contemplated. These signals are transmitted along electrical lead assembly 622 to the high-frequency vibrating actuator 604. Components of both the external vibrating actuator 602 and the implanted vibrating actuator 604 are described above. These components include, but are not limited to, the bone fixture, screw, encapsulants, sound input elements, and so on, and are not described further.

Figure 7:
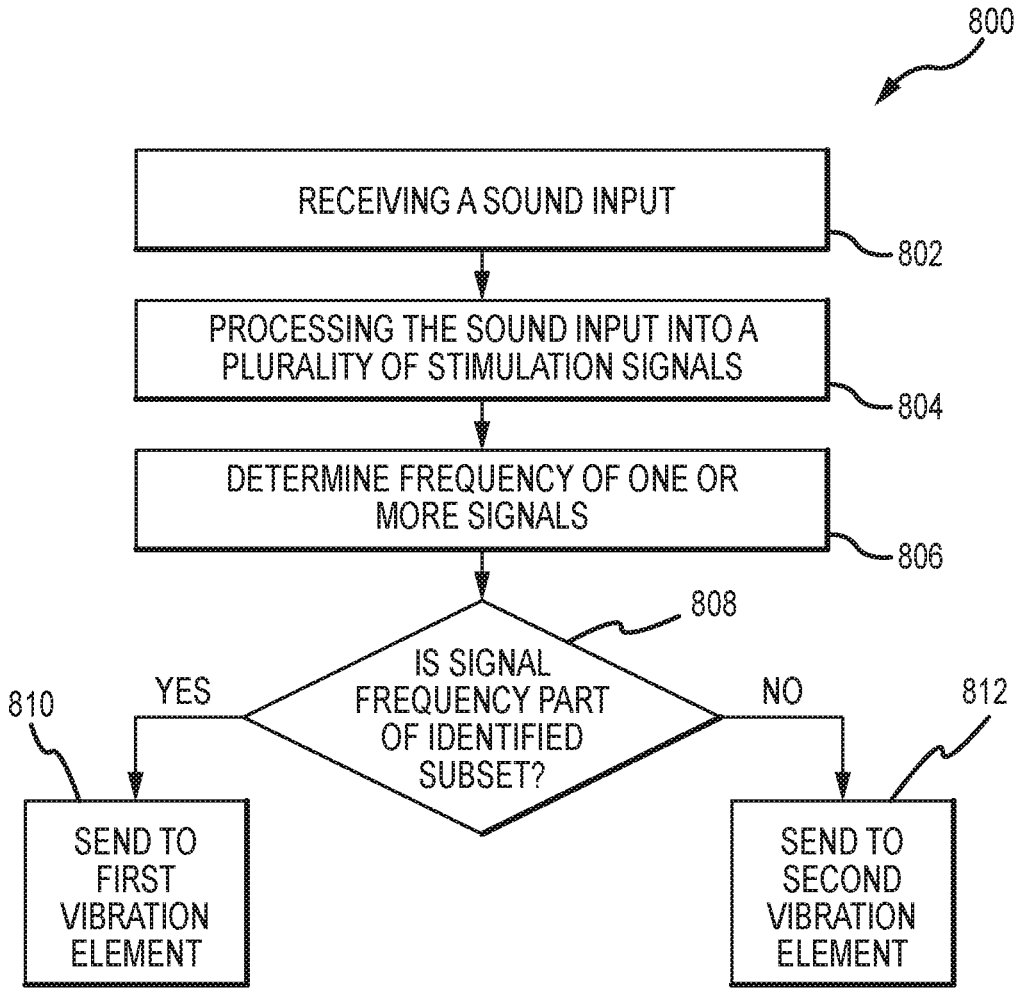
FIG. 7 depicts a method of delivering stimuli to a recipient.

FIG. 7 depicts a method 800 of delivering stimulus signals to a recipient. The method 800 begins with the receipt of a sound input in operation 802. The sound input is processed into a plurality of stimulation signals in operation 804. In an example, this processing 804 can include generating a first stimulation signal from the sound input comprising frequencies in a first frequency range, as well as generating a second stimulation signal from the sound input comprising frequencies in a second frequency range. Each discrete stimulation signal is associated with a frequency, which can be determined in operation 806, or as part of the processing operation. Thereafter, each frequency is categorized into one of a plurality of frequency subsets in operation 808. If, e.g., a stimulation signal falls within the subset, the signal is sent to a first vibration element in operation 810. Similarly, if a stimulation signal falls outside the subset, it is sent to a second vibration element in operation 812. This process can continue with first, second, and subsequent signals being sent to the appropriate vibration element based on their associated frequencies. As described above, even though only two frequency categories and vibration elements are described, a greater number of both can be utilized.

Figure 8:
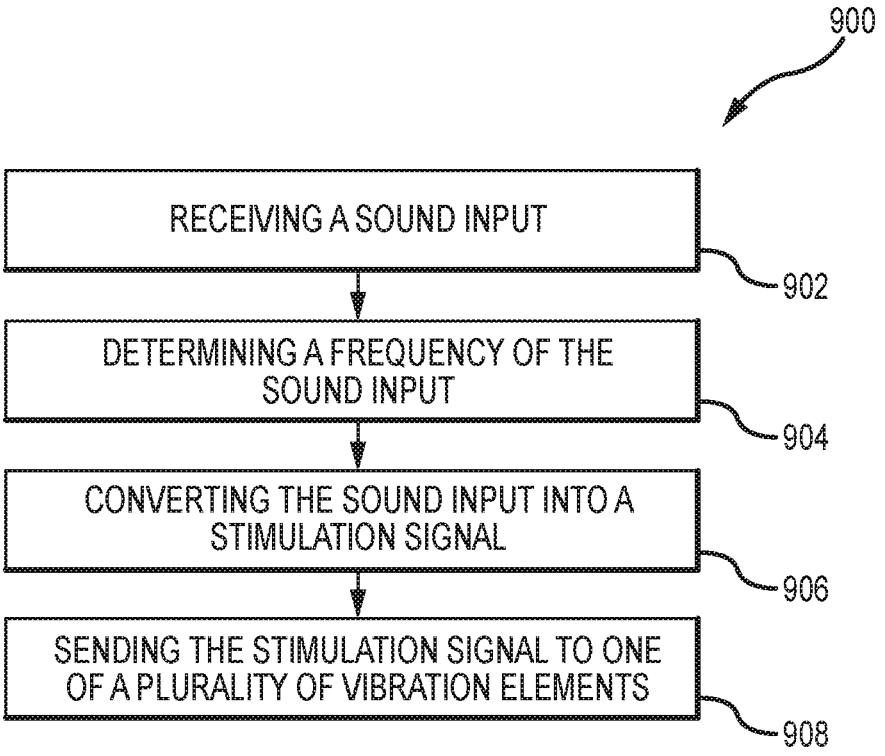
FIG. 8 depicts a method of delivering a stimulus signal to a recipient.

FIG. 8 depicts a method 900 of delivering a stimulus signal to a recipient. The method 900 begins with the receipt of a sound input in operation 902. A frequency of the sound input is determined in operation 904. Of course, for complex sounds inputs, multiple discrete frequencies can be present. In operation 906, the sound input is converted into a stimulation signal. In operation 908, the stimulation signal is sent to one of a plurality of vibration elements. As described elsewhere herein, two or more vibration elements fall within the scope of the disclosed technology. In examples, each of the plurality of vibration elements are disposed remote from each other. In other examples, one or each of the plurality of vibration elements are disposed remote from a sound input-receiving component, such as a microphone. By disposing the sound input-receiving element (e.g., a microphone) remote from the vibration elements, feedback to the microphone can be reduced or eliminated.

Figure 9:
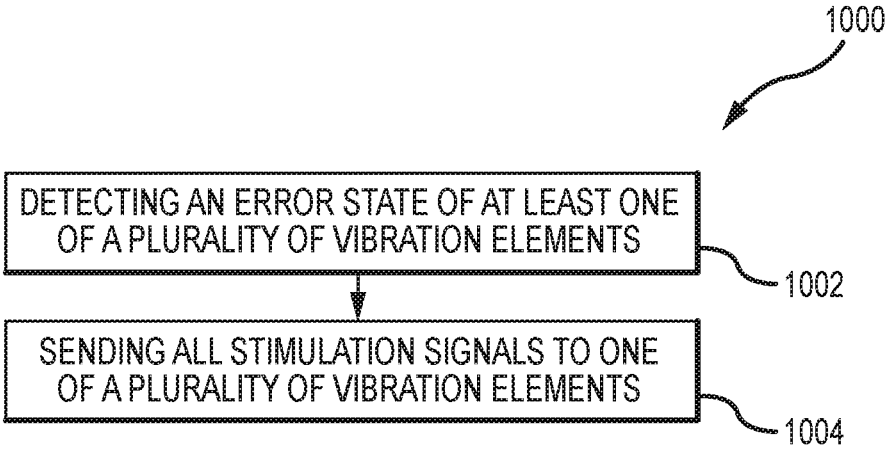
FIG. 9 depicts a method of responding to an error state in a multi-actuator bone conduction device.

FIG. 9 depicts a method 1000 of responding to an error state in a multi-actuator bone conduction device. Such error states can include, e.g., a mechanical failure of the vibration element, a dislodgment of an electrical lead to the vibration element, and so on. This method 1000 leverages the redundancy present when multiple vibration elements are present in a bone conduction auditory prosthesis. In such a device, one or more of the vibration elements can have structure that allows that vibration element to be used to send all stimulation signals, regardless of frequency. As described elsewhere herein, discrete vibration elements are utilized so as to deliver stimuli associated with a specific range of frequencies. Each of the vibration elements, however, can be configured to stimulate based on any frequency. During use, one vibration element can vibrate when high-frequency stimulation is required, while another vibration element can vibrate when low-frequency stimulation is required. This division of frequency ranges can be controlled by the sound processor, which sends the appropriate signal only to the appropriate vibration element. However, if an error state of one of the several vibration elements is detected, as indicated in operation 1002, the sound processor can send all stimulation signals to only one of the plurality of vibration elements (e.g., the error-free vibration element). That vibration element can then deliver all of the stimulation signals to the recipient. This allows a recipient to still have acceptable performance of their device, even when a component of the device is operating in an undesirable manner.

Figure 10:
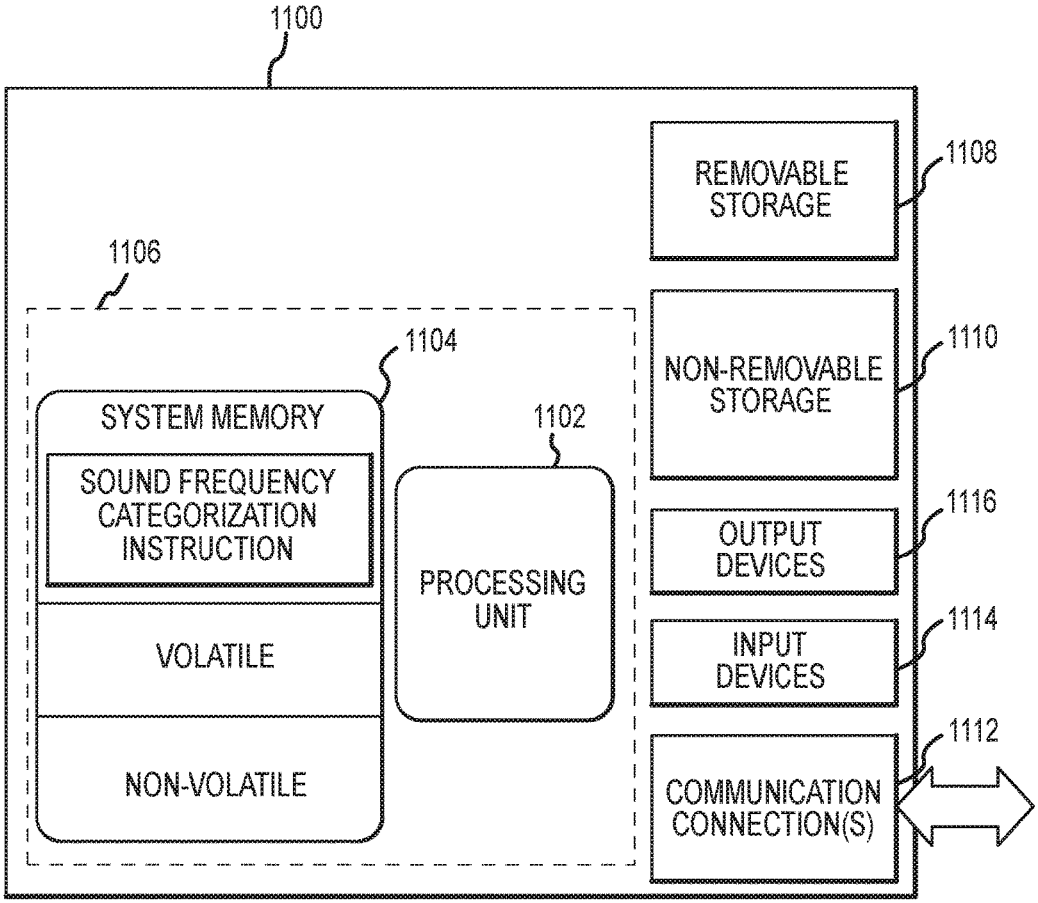
FIG. 10 depicts one example of a suitable operating environment in which one or more of the present examples can be implemented.

FIG. 10 illustrates one example of a suitable operating environment 1100 in which one or more of the present embodiments can be implemented. This is only one example of a suitable operating environment and is not intended to suggest any limitation as to the scope of use or functionality. One such operating environment 1100 can be the sound processor and related modules of an auditory prosthesis.

In its most basic configuration, operating environment 1100 typically includes at least one processing unit 1102 and memory 1104. Depending on the exact configuration and type of computing device, memory 1104 (storing, among other things, instructions to identify sound frequencies and appropriate vibration elements, as described herein) can be volatile (such as RAM), non-volatile (such as ROM, flash memory, etc.), or some combination of the two. This most basic configuration is illustrated in FIG. 11 by line 1106. Further, environment 1100 can also include storage devices (removable, 1108, and/or non-removable, 1110). In the context of an auditory prosthesis, removable storage devices 1108 can be connected, e.g., to the prosthesis via an auxiliary port. Similarly, environment 1100 can also have input device(s) 1114 such as touch screens, buttons or switches, microphones for voice input, etc.; and/or output device(s) 1116 such as a display, indicator button stimulator unit for delivery of stimulus to a recipient, etc. Also included in the environment can be one or more communication connections, 1112, such Bluetooth, RF, etc.

Operating environment 1100 typically includes at least some form of computer readable media. Computer readable media can be any available media that can be accessed by processing unit 1102 or other devices comprising the operating environment. By way of example, and not limitation, computer readable media can comprise computer storage media and communication media. Computer storage media includes volatile and nonvolatile, removable and non-removable media implemented in any method or technology for storage of information such as computer readable instructions, data structures, program modules or other data. Removable media can be connected to the auditory prosthesis via an auxiliary port. Such media is also referred to herein as "connectable media." Examples of removable (connectable) and non-removable computer storage media include, RAM, ROM, EEPROM, flash memory or other memory technology, or any other non-transitory medium which can be used to store the desired information. Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The operating environment 1100 can be a single auditory prosthesis operating alone or in a networked environment using logical connections to one or more remote devices. The remote device can be, in certain examples, a smartphone, tablet, MP3 player, or other devices that can deliver signals to an auditory prosthesis. For example, an appropriately configured MP3 player can deliver sound (e.g., music) signals wirelessly to the auditory prosthesis, which can then send signals corresponding to those sound signals to the appropriate vibration element (e.g., the high- or low-frequency actuator) within the auditory prosthesis. In some aspects, the components described herein comprise such modules or instructions executable by computer system 1100 that can be stored on computer storage medium and other tangible mediums and transmitted in communication media. Computer storage media includes volatile and non-volatile, removable (connectable) and non-removable media implemented in any method or technology for storage of information such as computer readable instructions, data structures, program modules, or other data. Combinations of any of the above should also be included within the scope of readable media.

This disclosure described some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art.

Although specific aspects are described herein, the scope of the technology is not limited to those specific examples. One skilled in the art will recognize other examples or improvements that are within the scope of the present technology. Therefore, the specific structure, acts, or media are disclosed only as illustrative examples. The scope of the technology is defined by the following claims and any equivalents therein.

What is claimed is:

1. An apparatus comprising:

an auditory prosthesis housing;

a sound processor disposed within the auditory prosthesis housing;

a first vibration actuator configured to be wearable by a recipient and in communication with the sound processor; and a second vibration actuator configured to be implanted in the recipient and in communication with the sound processor, wherein the first vibration actuator and the second vibration actuator are each bone conduction vibratory actuators configured to cause hearing percepts in the recipient by delivering vibration stimuli to the recipient's skull via respective first and second bone fixtures.

2. The apparatus of claim 1, wherein the sound processor is configured to send a first set of signals corresponding to a first sound frequency range to the first vibration actuator and a second set of signals corresponding to a second sound frequency range to the second vibration actuator, wherein the first sound frequency range is different from the second sound frequency range.

3. The apparatus of claim 2, wherein the second sound frequency range includes at least one sound frequency greater than the frequencies of the first sound frequency range.

4. The apparatus of claim 1, wherein the first vibration actuator is disposed proximate the auditory prosthesis housing and the second vibration actuator is disposed distal from the auditory prosthesis housing, relative to the first vibration actuator.

5. The apparatus of claim 4, wherein the first vibration actuator is disposed within the auditory prosthesis housing.

6. The apparatus of claim 1, wherein the second vibration actuator is connected to the auditory prosthesis housing with an implantable lead.

7. The apparatus of claim 6, further comprising:

a bone anchor configured to be coupled to the first bone fixture and defining an opening for routing the implantable lead.

8. The apparatus of claim 7, wherein the implantable lead is routed though the opening.

9. The apparatus of claim 6, wherein the implantable lead includes an implantable connection element for removably connecting the auditory prosthesis housing to the implantable lead.

10. The apparatus of claim 1, further comprising:

a first pressure plate; and an implantable second pressure plate configured to be anchored to the recipient's skull via the first bone fixture, wherein the first vibration actuator is connected to the first pressure plate so as to deliver a stimulus transcutaneously to the recipient via the implantable second pressure plate.

11. The apparatus of claim 10, further comprising:

an implantable receiver coil disposed within a biocompatible encapsulant and communicatively coupled to the second vibration actuator via an electrical lead assembly, wherein the second vibration actuator is configured to be in communication with the sound processor via the implantable receiver coil; and wherein the implantable second pressure plate is disposed within the biocompatible encapsulant.

12. The apparatus of claim 1, wherein the first vibration actuator is a low-frequency vibration actuator configured to generate vibrations at a first frequency range; and wherein the second vibration actuator is a high-frequency vibration actuator configured to generate vibrations in a second frequency range, the second frequency range including at least one frequency greater than the frequencies of the first frequency range.

13. The apparatus of claim 12, wherein the first frequency range and the second frequency range overlap.

14. The apparatus of claim 12, wherein the first frequency range and the second frequency range are discrete from each other.

15. The apparatus of claim 1, wherein the first vibration actuator is a piezoelectric transducer; and wherein the second vibration actuator is an electromagnetic transducer.

16. The apparatus of claim 1, wherein the sound processor is configured to restrict the second vibration actuator to producing vibrations below a transition frequency.

17. The apparatus of claim 1, wherein the first vibration actuator is configured to deliver vibrations percutaneously.

18. The apparatus of claim 1, further comprising:

an implantable receiver coil communicatively coupled to the second vibration actuator via an electrical lead assembly, wherein the second vibration actuator is configured to be in communication with the sound processor via the implantable receiver coil.

19. The apparatus of claim 1, wherein the first vibration actuator is an electromagnetic transducer; and wherein the second vibration actuator is a piezoelectric transducer.

20. An apparatus comprising:

an auditory prosthesis housing configured to be wearable by a recipient;

a sound processor disposed within the auditory prosthesis housing;

a piezoelectric transducer in communication with the sound processor; and an electromagnetic transducer configured to be implanted in the recipient and in communication with the sound processor, wherein the piezoelectric transducer and the electromagnetic transducer are each bone conduction vibratory actuators configured to cause hearing percepts in the recipient.

* * * * *